US008171683B2

(12) United States Patent
Wrightman et al.

(10) Patent No.: US 8,171,683 B2
(45) Date of Patent: May 8, 2012

(54) LOG FOR LOG HOME

(76) Inventors: Robert A. Wrightman, Bracebridge (CA); Ronald A. Wrightman, Bracebridge (CA)

( * ) Notice: Subject to any disclaimer, the term of this patent is extended or adjusted under 35 U.S.C. 154(b) by 106 days.

(21) Appl. No.: 11/892,960

(22) Filed: Aug. 28, 2007

(65) Prior Publication Data

US 2008/0127583 A1 Jun. 5, 2008

Related U.S. Application Data

(60) Provisional application No. 60/840,614, filed on Aug. 28, 2006, provisional application No. 60/868,006, filed on Nov. 30, 2006.

(51) Int. Cl.
*E04B 1/10* (2006.01)

(52) U.S. Cl. ..... 52/233; 52/586.1

(58) Field of Classification Search ..... 52/233, 52/284, 586.1, 105; 446/106
See application file for complete search history.

(56) References Cited

U.S. PATENT DOCUMENTS

| | | | | |
|---|---|---|---|---|
| 2,498,551 A | | 2/1950 | Jonsrud | |
| 3,166,802 A | | 1/1965 | Schmidgall | |
| 3,189,950 A | | 6/1965 | Johnson | |
| D203,663 S | | 2/1966 | Blum et al. | |
| 3,381,428 A | | 5/1968 | Sillman | |
| 3,440,784 A | | 5/1969 | Onjukha | |
| 3,552,079 A | | 1/1971 | Mortensen | |
| 4,126,977 A | * | 11/1978 | Chisum | 52/233 |
| 4,279,108 A | * | 7/1981 | Collister, Jr. | 52/233 |
| 4,599,837 A | | 7/1986 | Wrightman | |
| 4,901,489 A | | 2/1990 | Garber | |
| 4,903,447 A | * | 2/1990 | McDade | 52/233 |
| 4,938,263 A | | 7/1990 | Wrightman | |
| 5,020,289 A | * | 6/1991 | Wrightman | 52/233 |
| 5,325,645 A | | 7/1994 | Wrightman | |
| 5,778,950 A | | 7/1998 | Wrightman | |
| 6,050,033 A | | 4/2000 | Wrightman | |

(Continued)

FOREIGN PATENT DOCUMENTS

CA 1264644 1/1990

(Continued)

OTHER PUBLICATIONS

"Distinctive Homes—Log, Timberframe, Conventional Log Sided and More . . . " Catalogue published by True North Log Homes. Inc. 2007. p. 200 (photocopy of page is enclosed showing prior cross sections of logs.).

*Primary Examiner* — Jessica Laux
(74) *Attorney, Agent, or Firm* — John R. S. Orange; Blake, Cassels & Graydon LLP

(57) ABSTRACT

A log is provided that has a pair of oppositely directed faces, one of the faces having a pair of tongues separated by a channel and the other face having a pair of grooves separated by a ridge. The tongues, grooves, ridge and channel respectively are dimensioned so as to inter-engage when logs are placed one on top of another. The base of the channel is spaced from the end face of the ridge to accommodate a pair of seals that are maintained laterally spaced apart in the channel so as to define an air space therebetween. A thermal break is thus provided between the seals in the channel to inhibit conduction of heat through the seal.

20 Claims, 5 Drawing Sheets

U.S. PATENT DOCUMENTS

| | | | | |
|---|---|---|---|---|
| D467,010 | S * | 12/2002 | Wrightman | D25/121 |
| 7,313,890 | B2 * | 1/2008 | Clarke | 52/233 |
| 7,318,299 | B2 * | 1/2008 | Chambers | 52/105 |
| D575,879 | S * | 8/2008 | Wrightman et al. | D25/121 |
| 2005/0268563 | A1 | 12/2005 | Wrightman | |

FOREIGN PATENT DOCUMENTS

| | | |
|---|---|---|
| CA | 1273468 | 9/1990 |
| CA | 2002665 | 12/1991 |

* cited by examiner

LOG FOR LOG HOME

This application claims priority from U.S. Provisional Patent Application No. 60/840,614 filed on Aug. 28, 2006 and U.S. Provisional Patent Application No. 60/868,006 filed on Nov. 30, 2006.

FIELD OF THE INVENTION

The present invention relates to logs used to form walls of buildings.

SUMMARY OF THE INVENTION

It is well known to form the walls of a building by stacking logs one on top of another. Traditionally this has been done using rough hewn logs of irregular shape with a tenon joint at the corners where the logs intersect. The spaces between the logs are then caulked or chinked to weatherproof the wall. This arrangement is time consuming as each log is hand-crafted and the caulking requires continuous maintenance to maintain the integrity of the wall structure.

In more recent years, buildings have been made from a manufactured log in which each log is of a uniform cross section. Raw logs are processed to produce a log of constant width and constant height along its length so that uniform courses of a wall can be built. Given the uniformity of the cross section of the log, it is also possible to machine the log such that there are inter-engaging formations on the abutting surfaces of the logs. These formations may be used to mechanically retain the log in situ and also have been used to provide a seal structure between the logs.

In Canadian Patent 1,273,468, there is shown a log profile in which a pair of tongues are formed on one face of the log and are received within a pair of grooves formed in the other face of the log. The tongues are separated by a channel and the grooves by a ridge that enters the channel. A seal is located between the ridge and groove so as to be compressed between the ridge and the base of the channel. Seals are also provided on the outer edges of the tongues to provide a further sealing function.

This design of seal is considered one of the premier seal arrangements in the manufactured log industry and is effective to maintain the integrity of a log wall over a long period of time. It has however been found that there is a constant need for improving the thermal efficiency of the walls of building and whilst the provision of the seals prevents flow of air between the logs, they also provide a potential thermal path to allow heat to be conducted through the seals between the interior and exterior of the building.

It is therefore an object of the present invention to provide a log in which the above disadvantages are obviated or mitigated.

In accordance with one aspect of the invention, there is provided a log having a pair of oppositely directed faces. One of the faces has a pair of tongues separated by a channel and the other face has a pair of grooves separated by a ridge. The tongues and grooves and ridge and channel respectively are dimensioned so as to inter-engage when logs are placed one on top of another. The base of the channel is spaced from the end face of the ridge to accommodate a pair of seals that are maintained laterally spaced apart in the channel so as to define an air space there between. A thermal break is thus provided between the seals in the channel to inhibit conduction of heat through the seal.

In another aspect of the present invention, there is provided a log having a pair of oppositely directed faces. One of the faces has a pair of tongues separated by a channel and the other face has a pair of grooves separated by a ridge. The tongues and channel are complementary to the grooves and ridge so that logs may be stacked one on top of the other with the tongue and channel inter-engaging the grooves and ridge. A sealant chamber is formed in one of the tongue and groove adjacent a laterally outer face thereof. The chamber has a base canted inwardly toward the interior of the log so as to support a seal member in the chamber against laterally outwardly directed movement.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
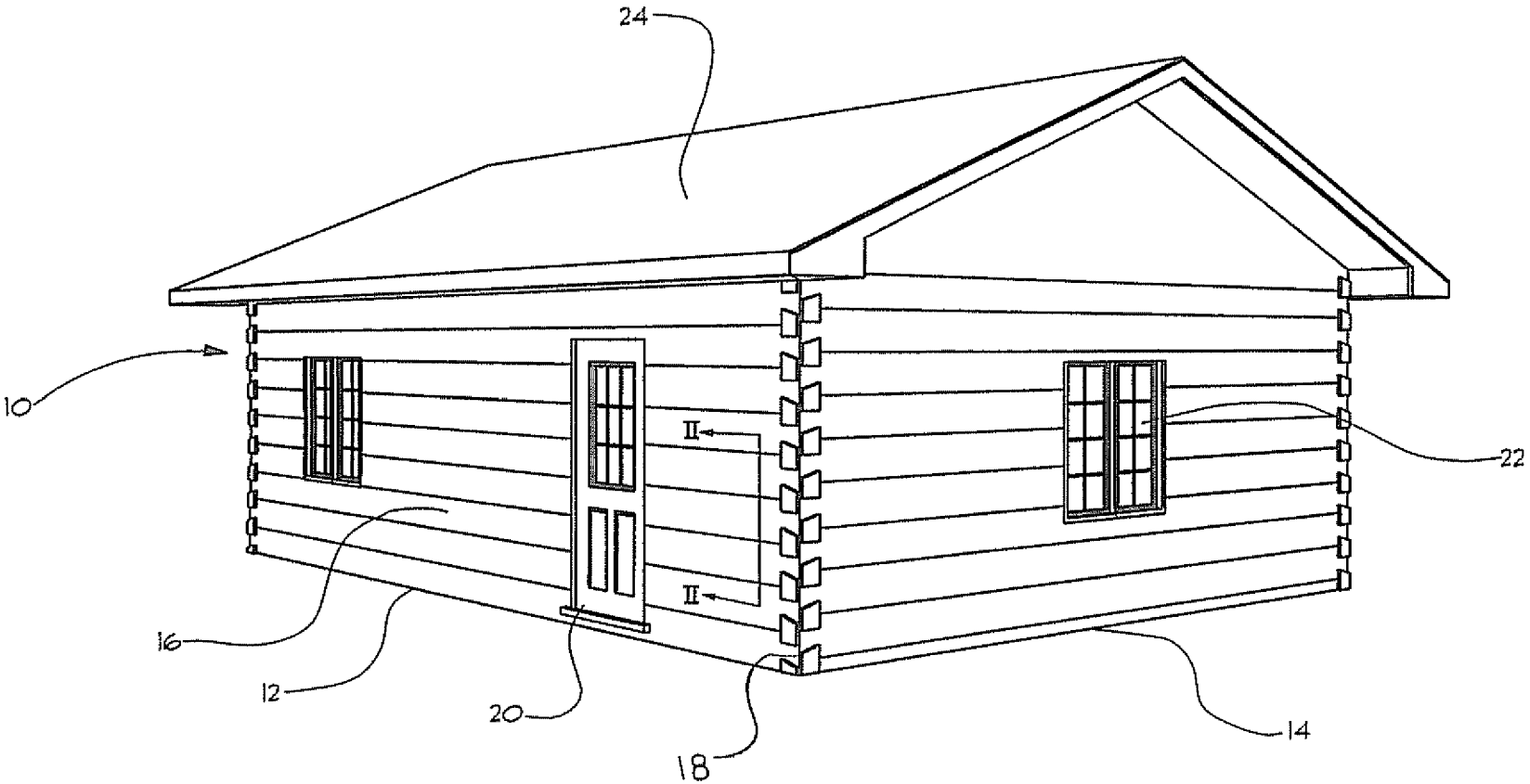
FIG. 1 is a perspective view of a log building.
Figure 2:
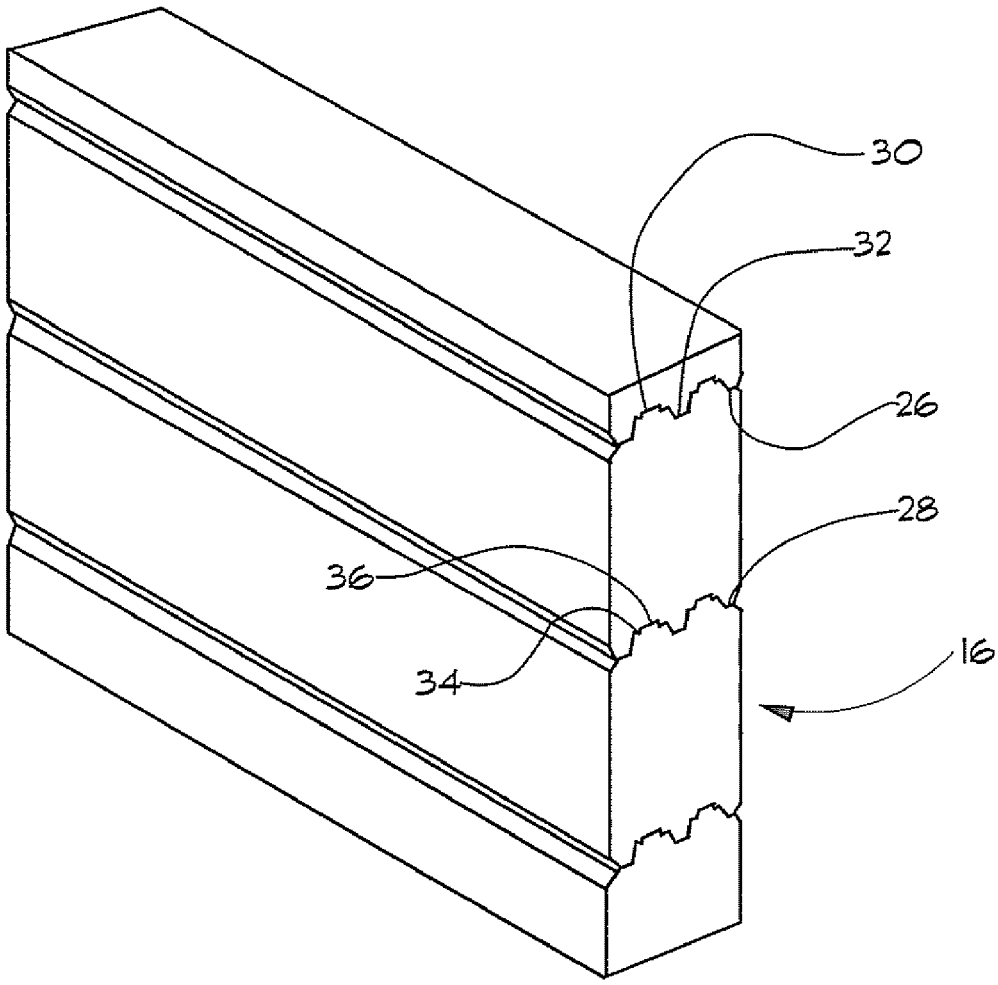
FIG. 2 is a view on the line II of FIG. 1.

Referring therefore to FIG. 1, a building generally indicated 10 has walls 12, 14 formed from logs 16 that extend horizontally one on top of another. The walls 12, 14 intersect at a corner 18 where the logs 16 are formed as an overlapping tenon joint, as is well known in the log building art. Openings are provided for doors 20 and windows 22 and the walls 12, 14 are surmounted by a roof structure 24. The formation of each of the walls 12, 14 is similar and is exemplified in greater detail in FIGS. 2 and 3. As may be seen from FIG. 2, the logs 16 have a pair of oppositely directed faces 26, 28 that, in conventional terminology, are referred to as the upper face 26 and lower face 28 in view of the orientation of the face when the log is incorporated into a wall. The upper face 26 has a pair of tongues 30 separated by a channel 32. The lower face 28 has a pair of grooves 34 separated by a ridge 36. The tongues 30 are dimensioned to fit within the grooves 34 and the ridge 36 dimensioned to fit within the channel 32, as is explained in greater detail with reference to FIG. 3, so that the faces 26, 28 of adjacent logs interdigitate when one log is placed on top of another.

Figure 3:
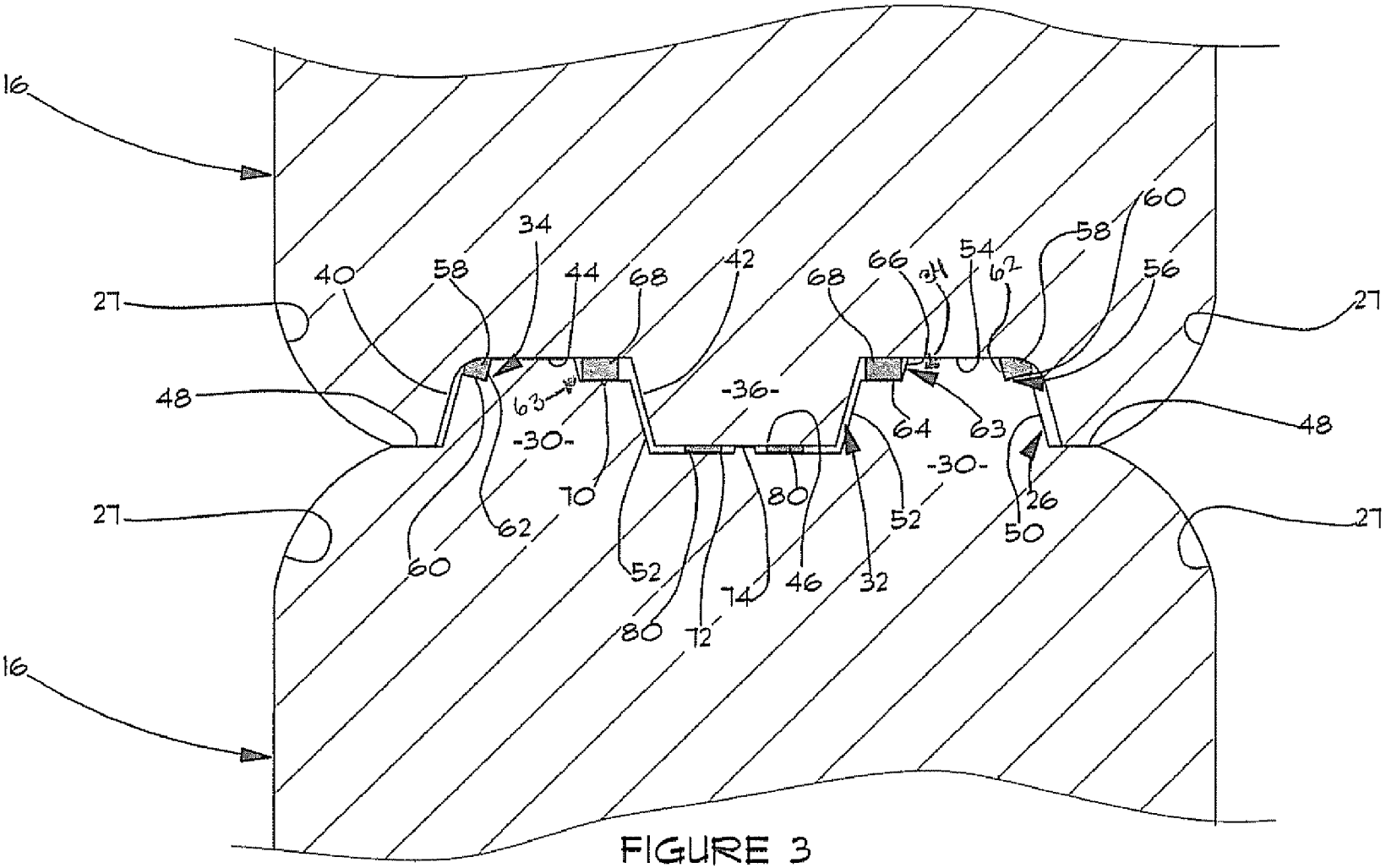
FIG. 3 is an enlarged view of a portion of the wall shown in FIG. 2.

Referring therefore to FIG. 3, each of the channels grooves 34 is trapezoidal in cross section having a pair of flanks 40, 42 that converge toward an end face 44. The flanks 42 also define the inclined faces of the ridge 36 and are delimited by a downwardly directed end face 46. The outer flanks 40 are delimited by base faces 48 that extend outwardly to the side faces 27.

Figure 4:
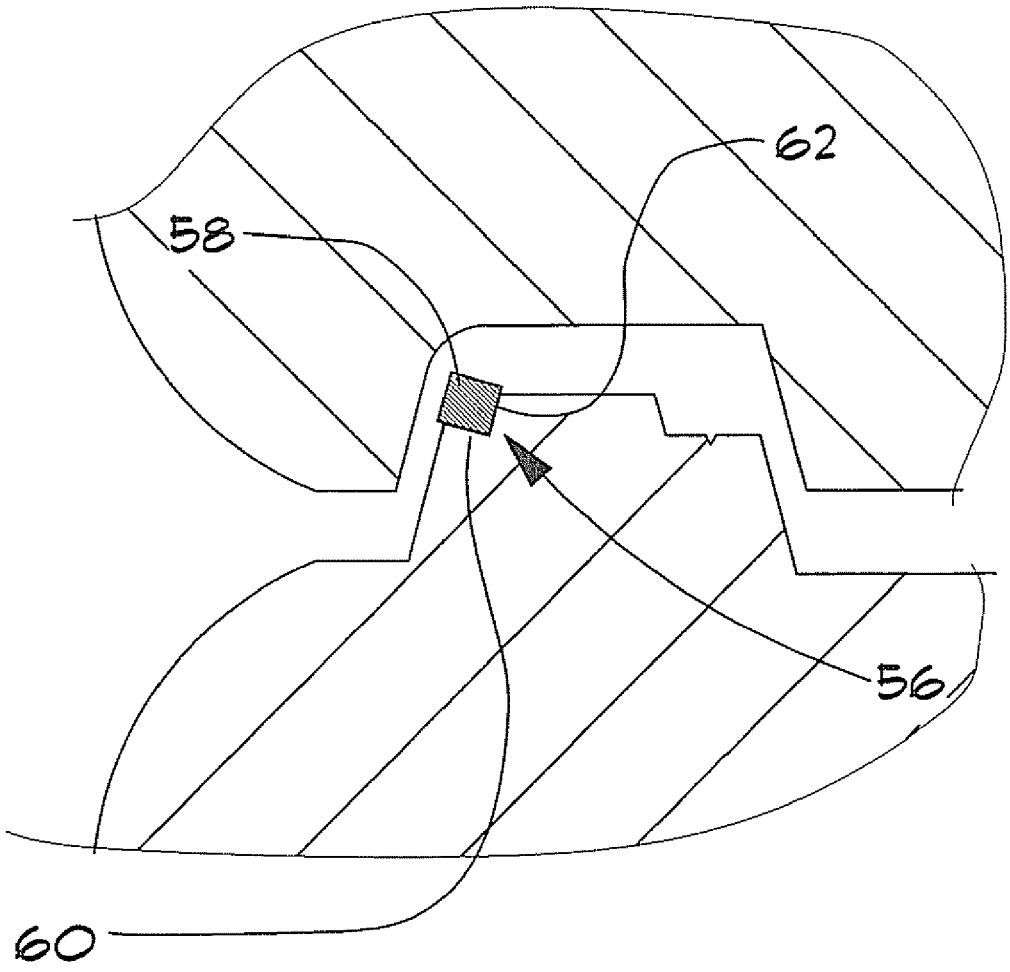
FIG. 4 is a view similar to FIG. 4 with the logs separated.

The cross section of the tongues 30 is similarly generally trapezoidal having a pair of convergent flanks 50, 52 that terminate at an end face 54. The outer apex of the intersection of the flanks 50 and end face 54 is formed with a recess 56 to accommodate a seal 58. As can be seen in greater detail in FIG. 4, the recess 56 has a base 60 that is canted inwardly toward the center of the log 16. A side face 62 intersects the end face 54 and forms a right angle with the base 60.

The inner apex of the intersection between the end face 54 and flank 52 is formed with a trapezoidal rabbet 63 having a base 64 generally parallel to the end face 54. The side face 66 is inclined so as to be parallel to the flank 52. A seal 68 located in the rabbet 63 adjacent the side face 66. A notch 70 is formed in the base 64 of one of the rabbets 63 to indicate the proper orientation of the log when installed, i.e., which is outside, and extends the length of the log 16.

The channel 32 is defined between the flanks 52 by a base face 72. A separating rib 74 is located centrally across the base face 72.

The spacing of the base face 72 from the end face 54 of the tongues 30 is slightly greater than the height of the ridge 36. Similarly, the spacing between the flanks 42 is slightly less than the spacing between the flank 52 such that a void is defined between nested formations on the logs 16. A void is also defined between the flank 40 and the flank 50 with the logs abutting. The rib 74 has a height that is less than the difference between the depth of the channel 32 and the height of the ridge 36. There is therefore a continuous void in the channel between the flanks 52 with a pair of seals 80 located in the void to either side of the rib 74.

The seals 58 are typically a butyl rubber seal that are flexible to permit compression. The seals 58 are square in cross section, typically ¼"×¼" in the free body state. The seals 68, 80 are typically an asphalt impregnated foam of rectangular free body dimension. For a typical log, the seals 68, 80 will be ¼"×⅜ or ¼"×½" Other seal materials such as flexible butyl or a bead of extruded butyl rubber or similar caulking material could also be used.

To assemble the wall 16, the first log 16 is placed on the foundation and the seals 58, 68 and 80 placed in their respective locations. The canting of the base 60 ensures that the seal 58 is received on the tongue 30 and is less likely to be dislodged during subsequent assembly. The canting also provides an increased vertical dimension and an increased horizontal dimension to improve the sealing properties between the two logs. The next log 16 is then oriented with the grooves 34 generally aligned with the tongues 30. The second log is then lowered onto the log and the seals 58, 68 and 80 are compressed by the end faces 44, 46. The end face 44 abuts the end face 54 to limit movement, maintaining the seals 58, 68, 80 in a compressed state. During the compression, the rib 74 acts as a barrier between the seals 80 and maintains separation of the seals 80 to ensure a void is defined between the two seals 80.

Similarly, the relative dimensions of the tongue 30 and groove 34 is such as to define voids between the flanks 42 and 52 and the flanks 40 and 50. The voids between the seals 68 and seals 80, and between the pair of seals 80 define a series of thermal breaks from the exterior to the interior of the wall. At the same time. the seals 58, 68 and 80 inhibit air flow between the voids, and thus between the exterior and interior of the wall. The integrity of the wall is thus maintained with thermal breaks to inhibit heat transfer.

Figure 5:
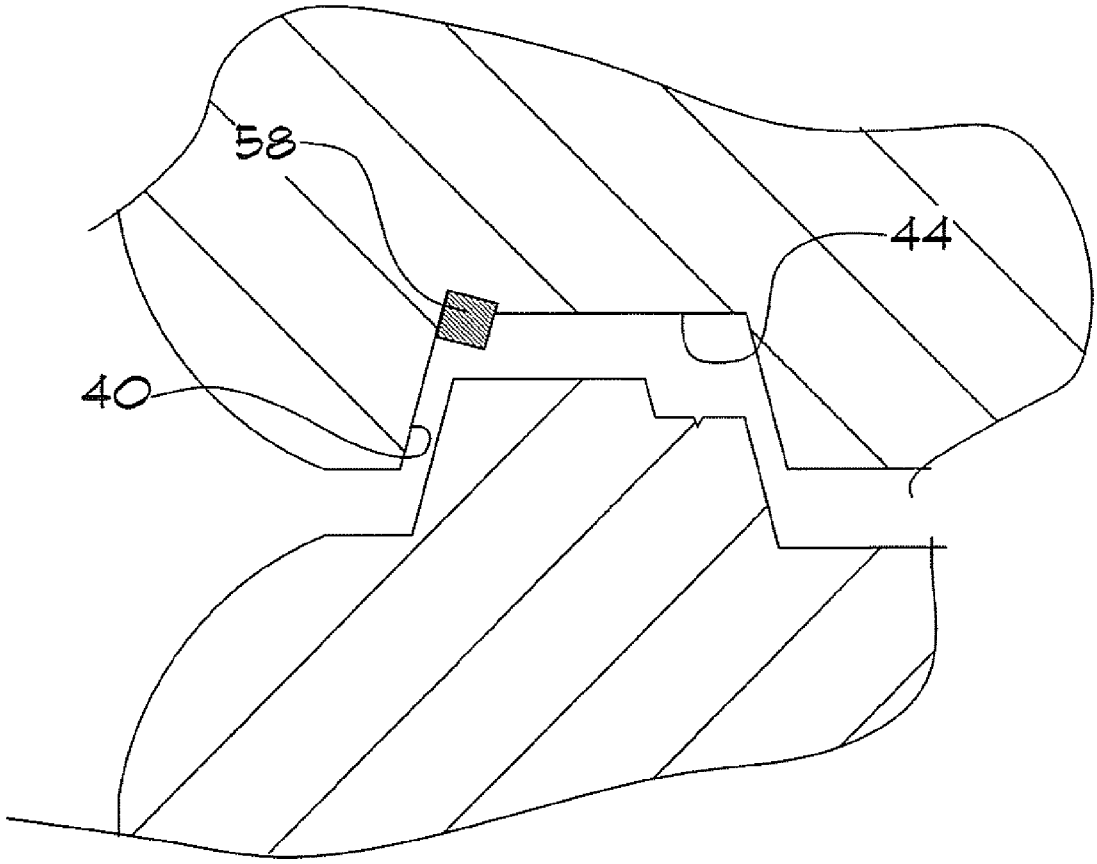
FIG. 5 is an alternative embodiment of the arrangement shown in FIG. 4.

An alternative embodiment is shown in FIG. 5 in which the seal 58 is received within a grove formed in the lower face 28 at the apex defined between the end face 44 and the flank 40. The orientation of the groove is such that it is slightly undercut to assist in retention of the seal 58 during lowering of the log.

It will also be appreciated that the rib 74 may be formed on the end face of the ridge 36 to provide a barrier if preferred.

It will be seen therefore that an arrangement is provided in which a series of thermal breaks is provided between the logs and the seals are accommodated in a manner that ensures that the break is maintained whilst the logs are assembled.

The invention claimed is:

1. A log having a pair of oppositely directed faces, one of said faces having a pair of tongues, each defined by a pair of oppositely directed flanks interconnected by an end face, said tongues being separated by a channel and the other of said faces having a pair of grooves, each defined by a pair of opposed side walls interconnected by an end wall, said grooves being separated by a ridge, said tongues, channel, grooves and ridge being dimensioned relative to one another so as to inter-digitate when said one face of one log is placed on top of said other face of another log, with the flanks of each of said tongues being located between said side walls of a respective one of said grooves, and said ridge being received within said channel, said channel having a base spaced from an end face of a respective one of said tongues by a distance greater than the spacing between an end face of said ridge and said end wall of said grooves whereby said base is spaced from said end face of said ridge when said faces are interdigitated to define a void and one of said base of said channel and said end face of said ridge has a barrier projecting therefrom into said void to subdivide said void, said barrier maintaining a pair of seals placed in said void in spaced relationship on one of said base of said channel and said end face of said ridge.

2. A log according to claim 1 wherein said flanks extend from either side of said base to intersect respective ones of said end faces of said tongues, said log having a rabbet formed adjacent to the intersection of said flank and said end face of said tongue to accommodate a seal and maintain said seal in contact with a groove of an adjacent log.

3. A log according to claim 2 wherein an indicator is provided on one of said rabbets to differentiate one of said tongues from the other.

4. A log according to claim 3 wherein said indicator is a notch in said rabbet.

5. A log according to claim 1 wherein one of said flanks is an outwardly directed flank that delimits said end face of each of said tongues, and a sealing surface is formed at an intersection of said outwardly directed flank and said end face.

6. A log according to claim 5 wherein said sealing surface is formed by a rabbet in said end face adjacent to said outwardly directed flank.

7. A log according to claim 6 wherein said rabbet has a side intersecting said end face and a base spaced from and diverging from said end face so as to cant a seal located therein toward said channel.

8. A log according to claim 5 wherein a recess is formed in respective ones of said groove to accommodate a seal and position it for contact with said sealing surface of a tongue of another log.

9. A log according to claim 5 wherein said flanks extend from either side of said base to intersect respective ones of said end faces of said tongues, said log having a rabbet formed adjacent to the intersection of said flank and said end face of said tongue to accommodate a seal and maintain said seal in contact with a groove of an adjacent log.

10. A log according to claim 9 wherein said sealing surface is formed by a rabbet in said end face adjacent to said outwardly directed flank.

11. A log according to claim 10 wherein said rabbet has a side intersecting said end face and a base spaced from and diverging from said end face so as to cant a seal located therein toward said channel.

12. A wall having a plurality of logs arranged generally horizontally with one face of one log juxtaposed with another face of another log, said one face having a pair of tongues, each defined by a pair of oppositely directed flanks interconnected by an end face, said tongues being separated by a channel and said other face having a pair of grooves, each defined by a pair of opposed side walls interconnected by an end wall, said grooves being separated by a ridge, said tongues, channel, grooves and ridge being dimensioned relative to one another so as to interdigitate when said faces are juxtaposed, with the flanks of each of said tongues being located between said side walls of a respective one of said grooves, and said ridge being received within said channel, a first pair of seals located on laterally outer apexes of said tongues to form a first seal between respective ones of said groove and said tongue, a second pair of seals located at laterally inner apexes of said tongues to provide a second seal between respective ones of said grooves and tongues, and a third pair of seals interposed between an end face of said ridge and a base of said channel, said third pair of seals maintained in spaced relationship by a barrier projecting from one of said end face of said ridge and said base of said channel and between said third pair of seals.

13. A wall according to claim 12 wherein a void is provided between respective ones of said second pair of seals and respective ones of said third pair of seals and a void is provided between respective ones of said third pair of seals.

14. A wall according to claim 12 wherein each of said first pair of seals is received in a rabbet having a side intersecting an end face of said tongue and a base spaced from diverging from said end face of said tongue to cant respective ones of said first pair of seals toward said channel.

15. A wall according to claim 14 wherein said rabbet is formed on said tongue.

16. A method of assembling a wall formed from a plurality of arranged generally horizontally one above another, with one face of one of said log juxtaposed with another face of another of said log, said one face having a pair of tongues, each defined by a pair of oppositely directed flanks interconnected by an end face, said tongues being separated by a channel and said other face having a pair of grooves, each defined by a pair of opposed side walls interconnected by an end wall, said grooves being separated by a ridge, said method comprising the steps of placing a first pair of seals to be positioned between laterally outer apexes of said tongues and respective ones of said grooves, placing a second pair of seals to be located between a laterally inner apex of said tongues and respective ones of said grooves, placing a third pair of seals to either side of a barrier extending from one of said ridge and said channel so as to be located between said ridge and said channel and assembling said logs one on top of the other such that said tongues and ridge interdigitate with said grooves and channel, with each said tongue being located between said side walls of a respective one of said grooves, and said ridge being received within said channel, and retain said seals in situ.

17. A log having a pair of oppositely directed faces, one of said faces having a pair of tongues, each defined by a pair of oppositely directed flanks interconnected by an end face, said tongues being separated by a channel and the other of said faces having a pair of grooves, each defined by a pair of opposed side walls interconnected by an end wall, said grooves being separated by a ridge, said tongues, channel, grooves and ridge being dimensioned relative to one another so as to inter-digitate when said one face of one log is placed on top of said other face of another log, with the flanks of each of said tongues being located between said side walls of a respective one of said grooves, and said ridge being received within said channel, a rabbet located in one of said tongue and said groove to locate a seal between a laterally outer apex of said tongue and said groove, said rabbet having a side intersecting said end face and a base spaced from and diverging from an end face of said tongue to cant said seal inwardly toward said channel, and a barrier is provided in said channel to maintain separation of a pair of seals, wherein said barrier is a rib formed in the base of said channel.

18. A log according to claim 17 wherein said rabbet is located in an apex of said tongue.

19. A log according to claim 18 wherein a further rabbet is located on a laterally inner apex of each of said tongues to locate an additional seal.

20. A log according to claim 19 wherein a rib is located in said channel.

* * * * *